US005277417A

United States Patent [19]

Moritake et al.

[11] Patent Number: 5,277,417

[45] Date of Patent: Jan. 11, 1994

[54] SHEET-MATERIAL TRANSPORTING DEVICE AND AUTOMATIC SHEET-MATERIAL FEEDER

[75] Inventors: Makoto Moritake; Yoshikazu Konoya; Kikuzo Nozawa, all of Kanagawa, Japan

[73] Assignee: Fuji Photo Film Co., Ltd., Kanagawa, Japan

[21] Appl. No.: 864,614

[22] Filed: Apr. 7, 1992

[30] Foreign Application Priority Data

Apr. 9, 1991 [JP] Japan ..... 3-76444

[51] Int. Cl.[5] ..... B65H 3/52

[52] U.S. Cl. ..... 271/121; 271/258; 271/265

[58] Field of Search ..... 271/121, 124, 265, 258, 271/262

[56] References Cited

U.S. PATENT DOCUMENTS

| | | | |
|---|---|---|---|
| 4,865,306 | 9/1989 | Himegi | 271/121 |
| 4,879,578 | 11/1989 | Hisajima et al. | 271/265 X |
| 4,887,806 | 12/1989 | Tanaka et al. | 271/121 |
| 5,052,677 | 10/1991 | Shibata | 271/121 X |
| 5,088,715 | 2/1992 | Shibata et al. | 271/121 X |

FOREIGN PATENT DOCUMENTS

| | | | |
|---|---|---|---|
| 0056227 | 3/1987 | Japan | 271/121 |
| 0096236 | 5/1987 | Japan | 271/121 |
| 0074843 | 4/1988 | Japan | 271/121 |
| 0104537 | 4/1989 | Japan | 271/121 |
| 0321224 | 12/1989 | Japan | 271/121 |
| 0321230 | 12/1989 | Japan | 271/121 |
| 2215710 | 9/1989 | United Kingdom | 271/262 |

*Primary Examiner*—H. Grant Skaggs
*Assistant Examiner*—Carol Lynn Druzbick
*Attorney, Agent, or Firm*—Sughrue, Mion, Zinn, Macpeak & Seas

[57] ABSTRACT

A sheet-material transporting device including a separation roller which is rotated in a predetermined direction; and a retarding member having an opposing surface opposing the separation roller, and forming a sheet-material transport passage between the opposing surface and the separation roller. The device is provided with a pressing member disposed in the opposing surface. The pressing member has a pressing surface which projects from the opposing surface and has a coefficient of friction smaller than that of the opposing surface. The pressing surface of the pressing member is caused to retract from its projecting position in correspondence with the thickness of the sheet material inserted into the transport passage. Accordingly, if, for example, two sheets are inserted in a superposed state into the transport passage, the pressing surface is caused to retract by a large amount. Hence, the sheet located on the opposing surface side is brought into contact with the opposing surface, and the transport thereof is hampered. At the same time, only the sheet located on the separation roller side slips over the sheet located on the opposing surface side and is transported by means of the rotational force of the separation roller.

25 Claims, 14 Drawing Sheets

SHEET-MATERIAL TRANSPORTING DEVICE AND AUTOMATIC SHEET-MATERIAL FEEDER

BACKGROUND OF THE INVENTION

1. Field of the Invention

The present invention relates to an automatic sheet-materal feeder, and more particularly to a sheet-material transporting device adapted to prevent a state in which a plurality of ultra thin sheets of paper are fed in a superposed or overlapping state (hereafter feeding in this state will be referred to as the overlapped feeding), as well as an automatic sheet-material feeder equipped with the sheet-material transporting device.

2. Description of the Related Art

A conventional automatic sheet-material feeder is shown in FIG. 13. In this apparatus, a retarding member 74 is disposed such that an opposing surface 72 thereof is located in proximity to an outer peripheral surface of a separation roller 70, which is rotated by an unillustrated driving means, and in such a manner as to extend in the axial direction of the separation roller 70 (i.e., in a direction perpendicular to the plane of the drawing of FIG. 13). A paper guide 76 extending in the axial direction of the separation roller 70 is attached to a side of the retarding member 74 to which the leading end of each document 56 placed on a hopper 78 is fed.

The hopper 78 in which the documents 56 are placed is moved by an unillustrated transfer mechanism to a position at which an uppermost one of the documents 56 is nipped by the paper guide 76 and the separation roller 70. As the separation roller 70 rotates, the uppermost one of the documents 56 is fed by a frictional force through the rotation of the separation roller 70, and is supplied to an unillustrated rotary camera for microfilm photographing, or the like.

In this case, the overlapped feeding of the documents 56 is prevented by adjusting a gap between the outer peripheral surface of the separation roller 70 and the opposing surface 72 of the retarding member 74, an angle at which the retarding member 74 is disposed, and an angle at which the document 56 is fed into a nip between the retarding member 74 and the separation roller 70.

According to the above-described prior art, however, in a case where the documents 56 of varying thicknesses or the documents 56 of different paper quality (e.g. in the coefficient of friction) are present in a mixed form, it is difficult to properly set the aforementioned gap and the like, so that the overlapped feeding of the documents 56 is unavoidable.

In addition, if a leading (inserting-side) end of the document 56, i.e., the retarding member 74-side end thereof, becomes deformed and corrugated, as shown in FIG. 14, there is the problem that trough portions 56A abut against a bent portion 76A of the paper guide 76, with the result that buckling occurs. In addition, if buckling occurs in this manner, the document 56 is jammed between the retarding member 74 and the separation roller 70, or the document 56 is wrapped around the separation roller 70, thereby making it impossible to transport the documents 56.

SUMMARY OF THE INVENTION

In view of the above-described circumstances, it is an object of the present invention to provide a sheet-material transporting device capable of transporting a plurality of sheets of paper having varying thicknesses and quality one by one by reliably separating the same, and an automatic sheet-material feeder incorporating the sheet-material transporting device.

The sheet-material transporting device in accordance with one aspect of the invention comprises: roller means which is rotated in a predetermined direction; retarding means having an opposing surface opposing the roller means in such a manner as to form a transport passage having a distance with respect to the roller means, the distance being set in correspondence with the thickness of a sheet material to be transported; and pressing means provided with a pressing surface projecting from the opposing surface toward the roller means and having a coefficient of friction smaller than that of the opposing surface, the pressing surface being adapted to press toward the roller means the sheet material inserted into a nip between the roller means and the retarding means, and the pressing surface being adapted to retract in a direction in which the pressing surface moves away from the roller means in correspondence with the thickness of the sheet material.

In accordance with the above-described aspect, the distance between the roller means and the retarding means is set to transport one sheet of sheet material.

When one sheet of sheet material is inserted into the transport passage formed by the roller means and the opposing surface, this sheet material is pressed against the roller means by the pressing surface of the pressing means, and is transported by the rotating force of the roller means. In this case, since the sheet material is pressed against the pressing surface having a small coefficient of friction, so that the sheet material is transported smoothly.

Meanwhile, in the event that a plurality of (in this example, two) sheets of sheet material are fed into the transport passage in a superposed state, when the leading ends of the two sheets reach the transport passage, the pressing surface of the pressing means is caused to retract by a larger amount than in the case of one sheet. The sheet located on the pressing surface side is subjected to the rotating force of the roller means via the sheet located on the roller means side. However, the former sheet is brought into contact with the opposing surface of the retarding means having a greater coefficient of friction than that of the pressing surface, so that its movement in the traveling direction is hampered. As a result, slippage occurs between the sheet located on the pressing surface side and the sheet located on the roller means side, and only the latter is transported by the rotating force of the roller means. Then, when the sheet located on the roller means side is transported from the transport passage by the roller means and is discharged, only the sheet located on the pressing surface side is present between the roller means and the pressing surface. The pressing surface is then returned to its position in which it presses one sheet, and the sheet located on this pressing surface side is pressed by the roller means, and is transported smoothly on the pressing surface by the rotating force of the roller means. Thus even when a plurality of sheets are fed into a nip between the roller means and the retarding means, the sheets can be reliably transported one at a time.

It should be noted that it suffices if the pressing means is set in such a manner that when two sheets are inserted into the transport passage, the sheet on the opposing surface side is brought into contact with the opposing surface and the transport of that sheet is hampered. In terms of the amount of retraction of the pressing surface, the pressing surface may retract below the opposing surface of the retarding means, or to a position in which the pressing surface is located slightly above the opposing surface on the roller means side.

In addition, the pressing means may be a spring member having the pressing surface, or a soft member having the pressing surface. Furthermore, the pressing means may be constituted by two members, a sheet-like or plate-like member constituting the pressing surface and a support member resiliently supporting the sheet-like or plate-like member.

Furthermore, at least one of the roller means and the retard means may be made movable so that a distance between the roller means and the opposing surface of the retarding means can be changed in correspondence with the thickness of the sheet material to be conveyed. In this case, distance-changing means for moving at least one of the roller means and the retarding means may be provided separately.

In accordance with another aspect of the invention, feeding means may be provided for feeding a plurality of sheets of sheet material consecutively into the transport passage; sensor means may be provided for detecting whether or not the sheet material has been fed into the transport passage; and control means may be provided for stopping the transport of an ensuing sheet of sheet material by stopping the operation of the feeding means when it is detected by the sensor means that a preceding sheet has been inserted into the transport passage.

In addition, pressure-contacting means may be provided for bringing the sheet material into pressure contact with the roller means before the sheet material is fed into the transport passage. This pressure-contacting means may be constituted by a plate-like member. Furthermore, pressing and urging means may be provided for pressing portions of the sheet material located in the vicinity of transverse opposite ends of thereof against the roller means with an urging force when the sheet material is fed. This pressing and urging means may be constituted by a spring member.

In accordance with still another aspect of the invention, the automatic sheet-material feeder comprises: a separation roller which is rotated by driving means; a retarding member having an opposing surface opposing the separation roller in such a manner as to form a transport passage having a distance with respect to the separation roller, the distance being set in correspondence with the thickness of a sheet material to be transported; feeding means for feeding the sheet material into the transport passage; and pressing means provided with a pressing surface projecting from the opposing surface toward the separation roller and having a coefficient of friction smaller than that of the opposing surface, the pressing means being adapted to press toward the separation roller via the pressing surface the sheet material fed into a nip between the separation roller and the retarding member by the feeding means, and the pressing means being adapted to retract in a direction in which the pressing surface moves away from the separation roller in correspondence with the thickness of the sheet material.

In accordance with the above-described aspect, when one sheet of sheet material is inserted into the transport passage by the feeding means, this sheet material is pressed against the separation roller by the pressing surface of the pressing means, and is transported by the rotating force of the separation roller driven by the driving means. In this case, since the sheet material is pressed against the pressing surface having a small coefficient of friction, so that the sheet material is transported smoothly.

Meanwhile, in the event that a plurality of (in this example, two) sheets of sheet material are fed into the transport passage in a superposed state by the feeding means, when the leading ends of the two sheets reach the transport passage, the pressing surface of the pressing means is caused to retract by a larger amount than in the case of one sheet. The sheet located on the pressing surface side is subjected to the rotating force of the separation roller via the sheet located on the separation roller side. However, the former sheet is brought into contact with the opposing surface of the retarding member having a greater coefficient of friction than that of the pressing surface, so that its movement in the traveling direction is hampered. As a result, slippage occurs between the sheet located on the pressing surface side and the sheet located on the separation roller side, and only the latter is transported by the rotating force of the separation roller. Then, when the sheet located on the separation roller side is transported from the transport passage by the separation roller and is discharged, only the sheet located on the pressing surface side is present between the separation roller and the pressing surface. The pressing surface is then returned to its position in which it presses one sheet, and the sheet located on this pressing surface side is pressed by the separation roller, and is transported smoothly on the pressing surface by the rotating force of the separation roller. Thus even when a plurality of sheets are fed into a nip between the separation roller and the retarding member, the sheets can be reliably transported one at a time.

The above and other objects, features and advantages of the invention will become more apparent from the following detailed description of the invention when read in conjunction with the accompanying drawings.

BRIEF DESCRIPTION OF THE DRAWINGS

FIG. 9 is a block diagram illustrating a controller, a motor controlled by the controller, and so on;

DESCRIPTION OF THE PREFERRED EMBODIMENTS

Referring now to the accompanying drawings, a description will be given of the preferred embodiments of the present invention.

Figure 1:
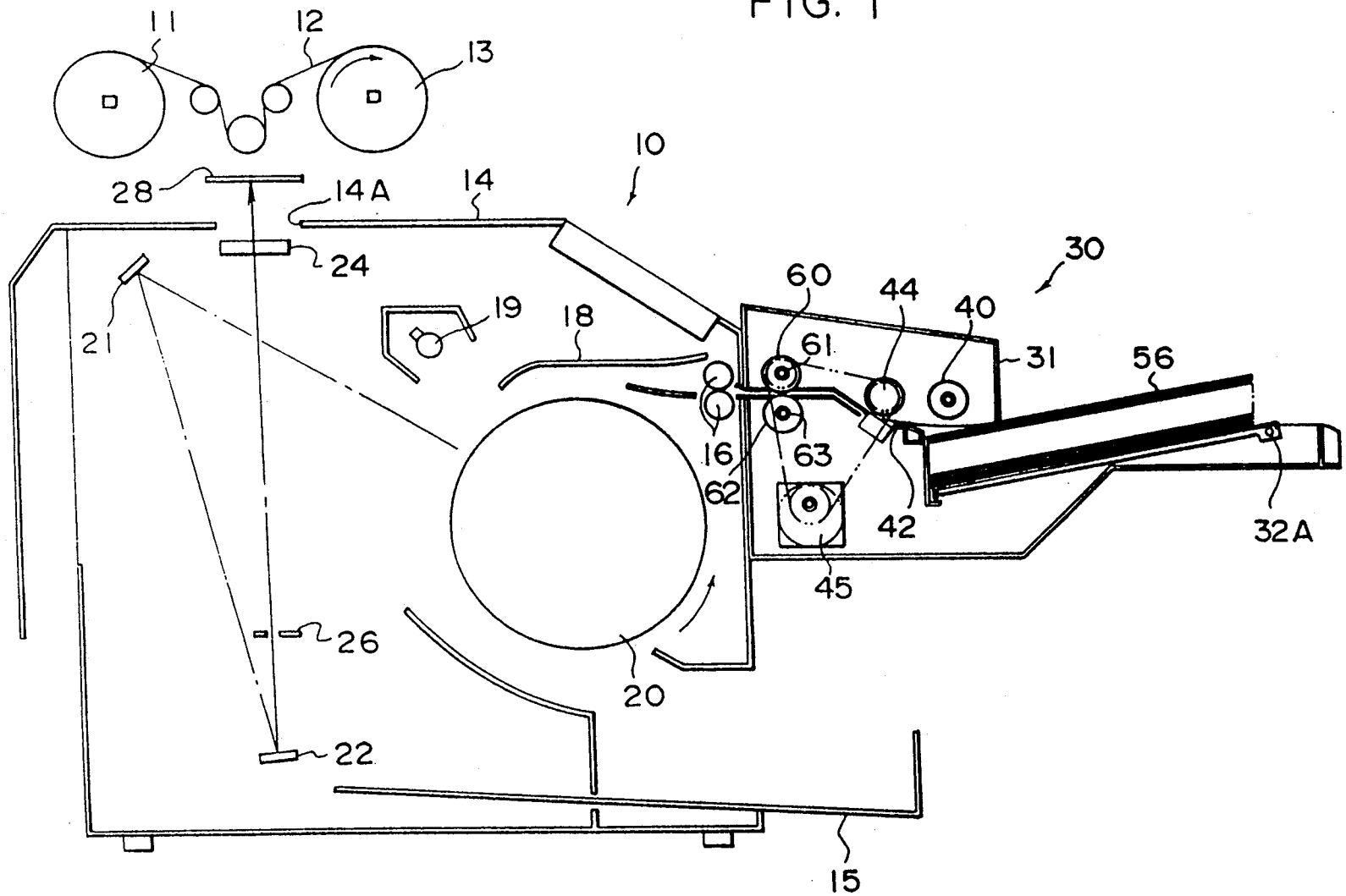
FIG. 1 is a side elevational view in a case where a sheet-material feeder in accordance with a first embodiment is applied to a rotary camera for microfilm photographing.

FIG. 1 shows an embodiment of an example in which a sheet-material feeder in accordance with the present invention is applied to a rotary camera for microfilm photographing.

In FIG. 1, an automatic sheet-material feeder 30 in accordance with this embodiment is provided in a stage preceding a microfilm photographing camera 10. As shown in an enlarged form in FIG. 2, a hopper 32 having one end (proximal end) supported rotatably about a horizontal shaft 32A is provided within a cover 31 of the automatic sheet. material feeder 30. The hopper 32 is operated by an unillustrated driving mechanism to rotate about the shaft 32A between an inclined position indicated by solid lines in FIG. 2 (a position in which the paper-placing surface of the hopper 32 is inclined) and a horizontal position indicated by two-dotted dash lines in FIG. 2. A stopper 34 is disposed substantially vertically in proximity to the other end (distal end) 32B of the hopper 32. A plurality of documents (sheet material) 56 are placed in the hopper 32 with their ends abutting against the stopper 34. As the documents 56, paper having a thickness ranging from 0.05 to 0.09 mm and a weight per square meters ranging from 30 to 60 g is used.

A prefeed roller 40 is disposed above the distal end 32B of the hopper 32. Accordingly, as the hopper 32 is rotated from the inclined position to the horizontal position with the horizontal shaft 32A as a center, the uppermost one of the documents 56 is brought into contact with the outer peripheral surface of the prefeed roller 40, and is transported downstream in the traveling direction of the documents 56 by the rotating force of the prefeed roller 40 rotated in the direction of arrow A in FIG. 2 (clockwise direction in FIG. 2) by an unillustrated motor.

Figure 3:
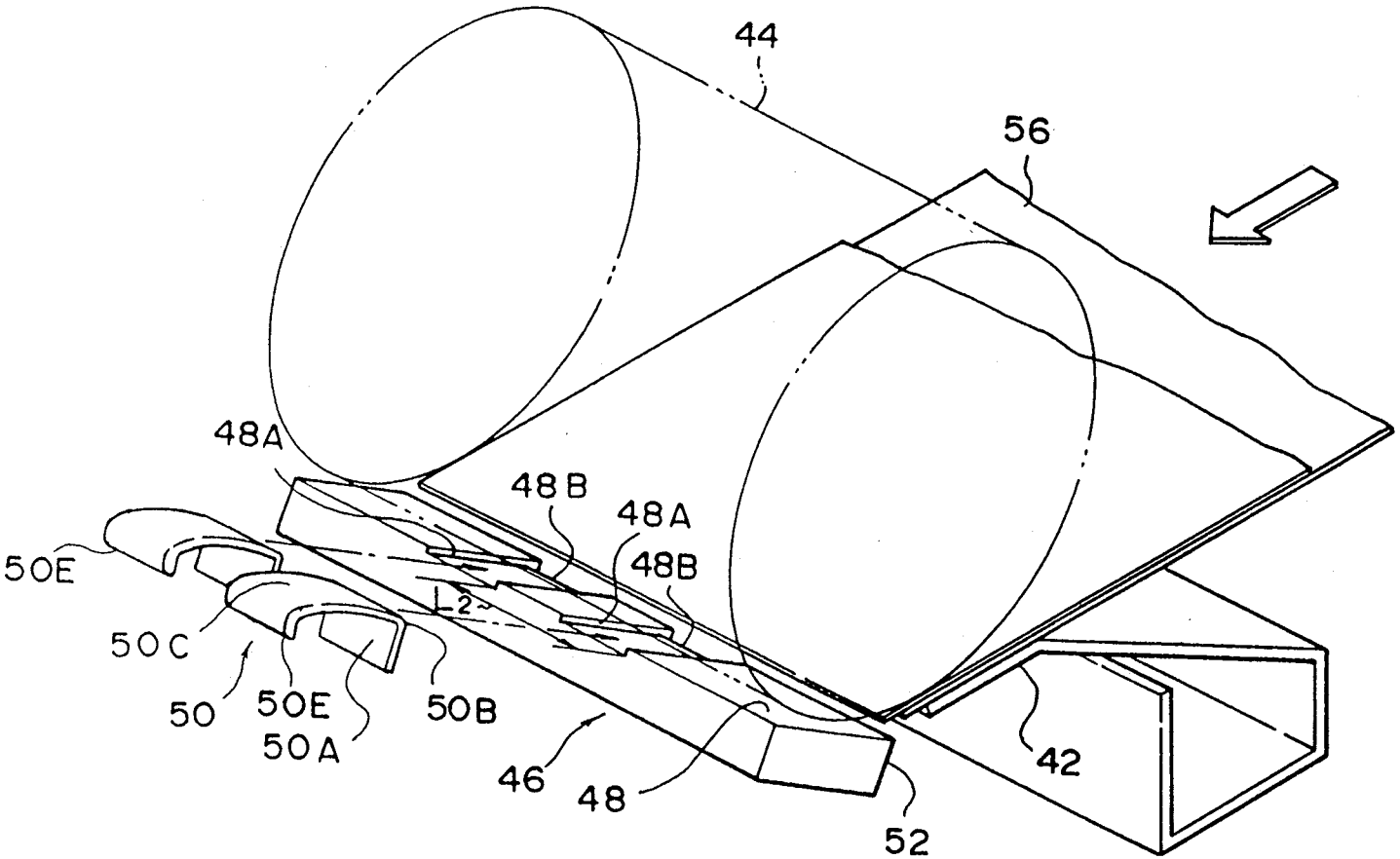
FIG. 3 is a perspective view of a retard plate and springs.

A guide plate 42 is disposed on the downstream side, as viewed in the traveling direction of the documents 56, of the hopper 32. As shown in FIG. 3, this guide plate 42 is arranged such that a portion thereof extends diagonally upward from a proximal portion, which is formed in the shape of a box and is located on the hopper 32 side, thereby forming an extended portion. A distal end of the extended portion is bent substantially horizontally and constitutes a horizontal portion. A separation roller 44 is disposed in proximity to an upper surface of the horizontal portion.

An elongated retard plate 46 having a substantially rectangular cross section is disposed on the downstream side, as viewed in the traveling direction of the documents 56, of the guide plate 42 in such a manner that its longitudinal direction is parallel with the axial direction of the separation roller 44. The retard plate 46 is arranged such that an opposing face 48 opposing the separation roller 44 is located in proximity to a lowermost portion of the separation roller 44 and is parallel with the tangential direction, and such that the opposing surface 48 is inclined diagonally upward from the upstream side toward the downstream side as viewed in the traveling direction. The retard plate 46 is formed of a material having a large frictional resistance such as urethane rubber. In addition, the gap between the opposing surface 48 and the outer peripheral surface of the separation roller 44 at a position where they are closest is set to be 0.0–0.03 mm or thereabouts in correspondence with the thickness of the document 56.

Figure 4A:
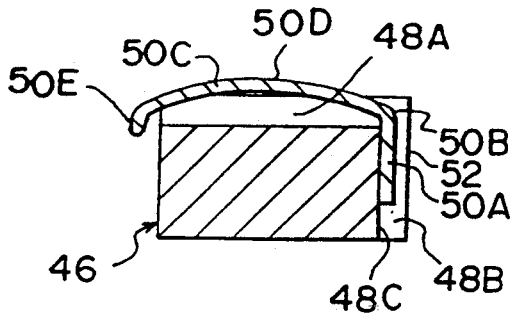
FIGS. 4A and 4B are side elevational views of the retard plate taken in the axial direction of a separation roller.
Figure 4B:
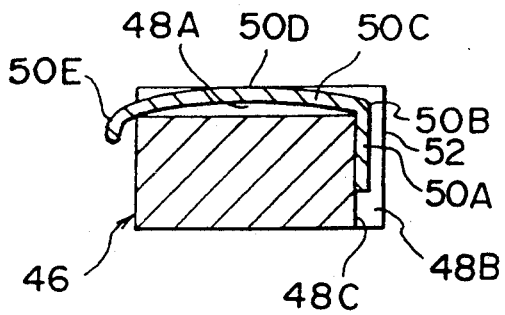
Figure 5:
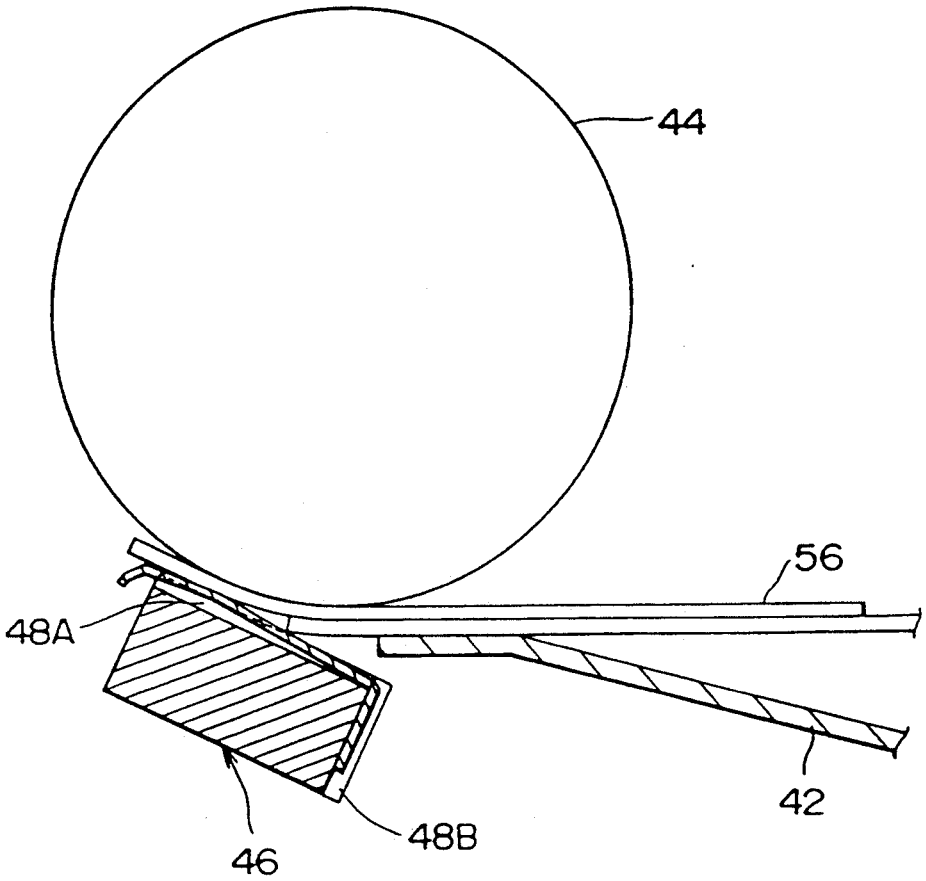
FIG. 5 is a partial cross-sectional view illustrating a manner in which a sheet material is transported by the sheet-material feeder.
Figure 14:
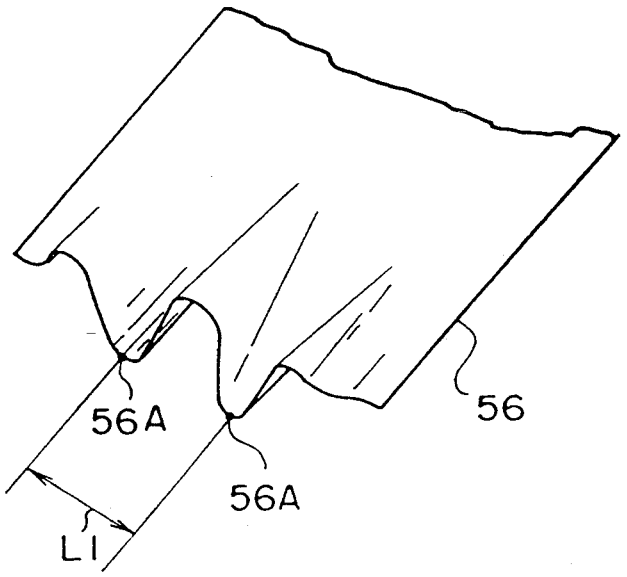
FIG. 14 PRIOR ART
FIG. 14 is a perspective view illustrating a corrugated state of paper.

A pair of rectangular grooves 48A are formed in the opposing surface 48 of the retard plate 46 in such a manner as to extend in a direction perpendicular to the longitudinal direction of the retard plate 46. As shown in FIGS. 4A, 4B, and 5, the grooves 48A communicate with grooves 48B formed in a side surface 52 on the upstream side, as viewed in the traveling direction of the documents 56, of the retard plate 46. An interval $L_2$ (see FIG. 3) between the two grooves 48A is set to be a dimension similar to an interval $L_1$ (see FIG. 14) between the two trough portions 56A at the corrugated leading end of the document 56, which has been described in the section on the description of the related art in connection with FIG. 14. A pair of springs 50 are disposed in these grooves 48A and 48B.

The springs 50 are leaf springs which are bent in a substantially L-shaped configuration, as shown in FIGS. 3, 4A, and 4B. Each spring 50 is comprised of a proximal portion 50A, a resiliently deformable portion 50C extending from a distal end portion 50B of the proximal portion 50A to the downstream side in the traveling direction, and a curved portion 50E. The proximal portion 50A is secured to a bottom 48C of the groove 48B by means of adhesion. A substantially central portion of the resiliently deformable portion 50C is curved so as to be convex toward the separation roller 44, with the result that the document 56 can be brought reliably into close contact with the separation roller 44. The springs 50 are formed of resilient members, such as stainless steel plates, whose frictional resistance is smaller than that of the retard plate 46.

It should be noted that, in a state in which the document 56 is not in contact with the resiliently deformable portions 50C, the resiliently deformable portions 50C are held in close contact with the separation roller 44 by means of their resiliency. In addition, as shown in FIG. 4B, in a state in which two or more documents are transported in a superposed state, the resiliently deformable portions 50C are pressed by the documents 56 and retract into the grooves 48A. As a result, pressing surfaces 50D of the resiliently deformable portions 50C opposing the separation roller 44 reach a position where the pressing surfaces 50D do not project from the opposing surface 48 toward the separation roller 44. The curved portions 50E serve to prevent the document 56 from entering the gap between the retard plate 46 and the resiliently deformable portions 50C, and may not be curved but be bent in an L-shape.

Figure 2:
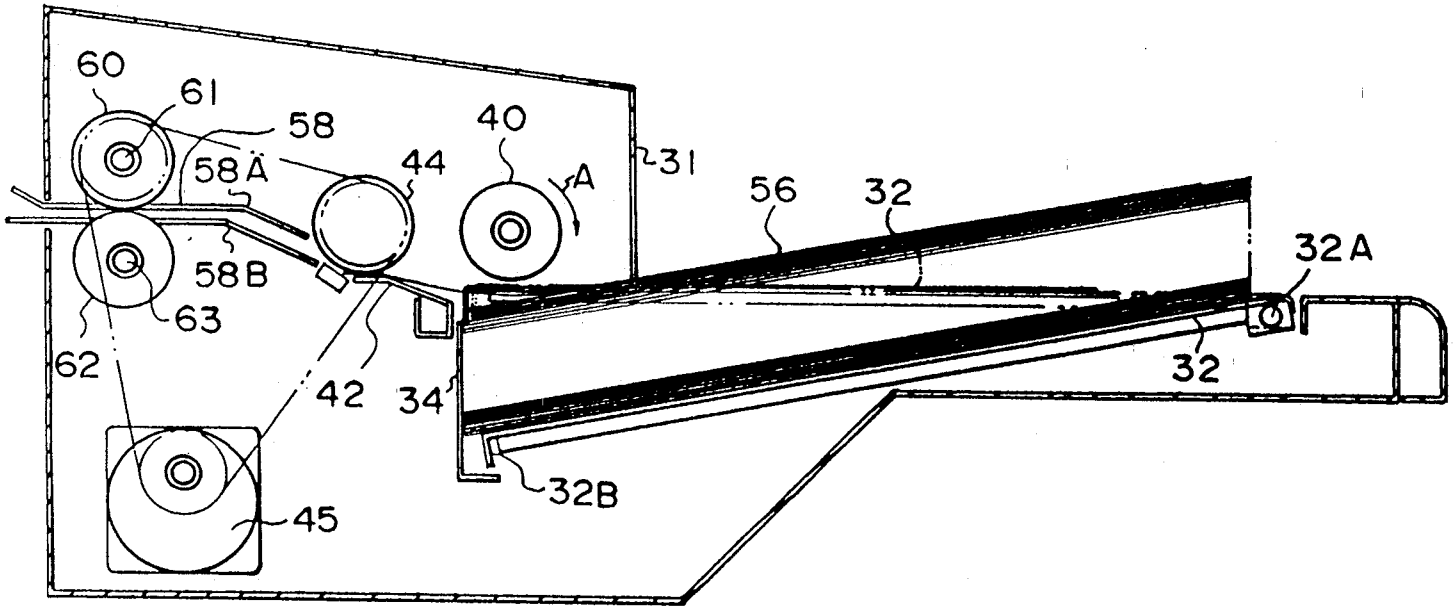
FIG. 2 is an enlarged cross-sectional view of the sheet-material feeder.

As shown in FIG. 2, a guide section 58 is disposed downstream of and in proximity to the gap between the retard plate 46 and the separation roller 44. This guide section 58 is comprised of an upper plate 58A and a lower plate 58B. The guide section 58 extends from a position in proximity to the gap in an extending direction of the opposing surface 48, and is then bent midway to extend horizontally. As shown in FIG. 1, an end of the guide section 58 on the downstream side in the traveling direction is inserted into a cover 14 of the rotary camera 10 for microfilm photographing.

In an intermediate portion of the horizontal, portion of the guide section 58, a pair of rollers 60 and 62, respectively supported by rotating shafts 61 and 63 arranged in parallel with each other, are rotatably disposed with their outer peripheral surfaces held in proximity to each other. Thus the rollers 60 and 62, together with the separation roller 44, are rotatable by receiving the driving force of a motor 45.

Referring to FIG. 1, a pair of rollers 16 are disposed inside the cover 14 of the rotary camera 10 for microfilm photographing. A guide 18 for guiding the document 56 to an outer surface of a rotating drum 20 is disposed on the downstream side, as viewed in the traveling direction, of the rollers 16. The document 56 fed by the automatic sheet. material feeder 30 is nipped and transported by the pair of rollers 16, is guided by the guide 18, and reaches the outer peripheral surface of the rotating drum 20 rotated counterclockwise.

A light source 19 for emitting light toward the outer periphery of the rotating drum 20 is provided inside the cover 14. Also provided inside the cover 14 are mirrors 21 and 22 and a slit 26 for introducing an image on the document 56 irradiated by the light source 19 to a photographing lens 24. A transmission hole 14A through which the light based on the image on the document 56 is bored in an upper surface of the cover 14, and a shutter 28 is provided in correspondence with this transmission hole 14A.

A supply reel 11 for consecutively supplying a film 12 to a position opposing the aforementioned transmission hole 14A and a takeup reel 13 for taking up the film 12 supplied are disposed outside the cover 14. A discharge table 15 onto which the document 56 is discharged is provided below the cover 14.

A description will now be given of the operation of this embodiment.

As the prefeed roller 40 rotates, an uppermost one of the documents 56 placed on the hopper 32, while being guided by the guide plate 42, is fed into nips between the separation roller 44 and the resiliently deformable portions 50C of the springs 50. In this case, even if the documents 56 of varying thicknesses are fed consecutively one sheet at a time, these resiliently deformable portions 50C undergo resilient deformation, and the document 56 is brought into pressure contact with the separation roller 44 by means of the resiliently deformable portions 50C. Accordingly, the documents 56 having varying thicknesses can be transported respectively without needing to adjust the gap between the separation roller 44 and the opposing surface 48 of the retard plate 46.

In the state in which the documents 56 are fed one sheet at a time, each document 56 is transported to the guide section 58 by the rotation of the separation roller 44 in a state in which the document 56 is pressed by the pressing surfaces 50D of the resiliently deformable portions 50C projecting from the opposing surface 48 of the retard plate 46, i.e., in a state in which the document 56 is floating above at least a portion of the retard plate 46. In this case, since the frictional resistance of the pressing surfaces 50D is made small, the document 56 is transported satisfactorily without a large resistance being imparted thereto. In addition, since the document 56 is transported while being pressed against the separation roller 44 by the resiliently deformable portions 50C, creases and the like are stretched.

The document 56 which has reached the guide section 58 is transported in a state in which it is nipped by the rollers 60 and 62, and is fed into the rotary camera 10 for microfilm photographing. The document 56 fed into the rotary camera 10 for microfilm photographing is transported by the rollers 16 and is fed to the rotating drum 20 via the guide 18. As the rotating drum 20 rotates, when the image on the document 56 reaches a position opposing the light source 19, the shutter 28 is opened, the supply reel 11 and the takeup reel 13 are operated, and the film 12 is supplied. The light emitted from the light source 19 and transmitted through the image on the document 56 in this state reaches the photographing lens 26 via the mirrors 21 and 22 and the slit 26, and is applied to the film 12, thereby imagewise exposing the film 12. Then, the document 56 is moved away from the rotating drum 20 and is discharged onto the discharge table 15. Meanwhile, in the event that a plurality of (e.g. two) documents 56 transported from the hopper 32, as described above, are fed into the nips between the separation roller 44 and the resiliently deformable portions 50C in a superposed state, the resiliently deformable portions 50C retract into the grooves 48A by means of the pressing force of these documents, so that the pressing surfaces 50D reach the position where they do not project from the opposing surface 48. Accordingly, the surface of a lower one (on the retard plate 46 side) of the two documents 56 fed in the superposed state is brought into contact with the opposing surface 48 of the retard plate 46 having a large frictional resistance. Hence, the transport of the lower one of the two superposed documents 56 is hampered, and only the upper one of the documents 56 is transported by the transporting force of the separation roller 44. This transported document 56 is transported in the same way as described above, and is discharged onto the discharge table 15. When the upper one of the documents 56 is transported and disappears from the pressing surfaces 50D, the pressing surfaces 50D project from the opposing surface 48, and the surface of the remaining one of the documents 56 fed in the superposed state ceases to abut against the retard plate 46. Hence, this document 56 is transported satisfactorily.

As described above, in this embodiment, since the document 56 is brought into pressure contact with the separation roller 44 and is transported by means of the springs 50 (pressing surfaces 50D) having a small frictional resistance without setting the gap between the retard plate 46 and the separation roller 44 depending on the thickness of the documents 56, documents having varying thicknesses can be reliably separated and transported one by one.

Furthermore, in this embodiment, since the pair of resiliently deformable portions 50 are provided at an interval corresponding to the length between the troughs 56A and 56A of the corrugated document 56, the troughs 56A are nipped by the resiliently deformable portions 50C and the separation roller 44 without biting into the opposing surface 48 of the retard plate 46, thereby allowing the document 56 to be transported satisfactorily.

Figure 6:
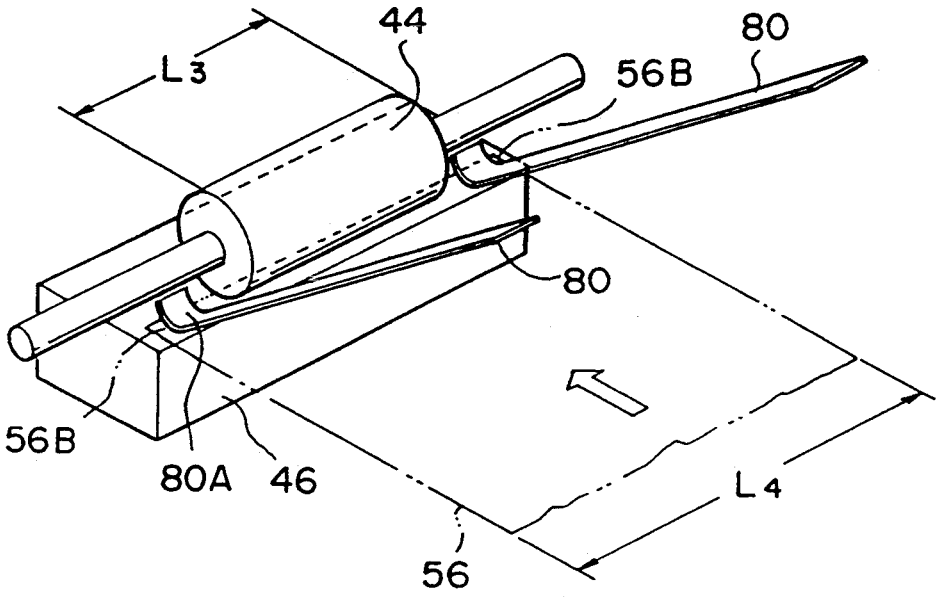
FIG. 6 is a perspective view of a second embodiment of the present invention.

Referring now to FIG. 6, a description will be given of a second embodiment of the present invention.

In this second embodiment, the pair of springs 50 are respectively disposed in the grooves 48A formed in the retard plate 46, in the same way as in the above-described embodiment. In FIG. 6, a longitudinal length $L_3$ of a separation roller 144, unlike the separation roller 44 of the first embodiment, is shorter than a widthwise dimension $L_4$ of the document 56. The document 56 is fed in a state in which its transverse opposite ends 56B project outside a longitudinal area of the separation roller 144.

Furthermore, this embodiment differs from the above-described first embodiment in that, in addition to the arrangement of the first embodiment, a pair of pressing plates 80 are provided.

These pressing plates 80 are formed of stainless steel plates, and their distal end portions on the retard plate 46 side are formed as curved portions 80A which are curved in such a manner as to be spaced apart from the retard plate 46. The surface of each curved portion 80A on the retard plate 46 side is formed as a curved surface. The curved portion 80A is in contact with the retard plate 46 at a position of contact between the separation roller 144 and the retard plate 46, or at a position slightly offset from that position toward the prefeed roller 40 (FIG. 1). Accordingly, the transverse ends 56B of the document 56 are brought into nips between the curved portions 80A of the pressing plates 80 and the retard plate 46, and the document 56 is then nipped by the separation roller 144 and the retard plate 46 (springs 50) and is transported. In this case, in a case where creases or the like are present at the transverse ends 56B of the document 56, these creases are stretched in advance, and the document 56 is then nipped by the separation roller 144 and the retard plate 46 (springs 50), so that the buckling, which would otherwise occur when the document 56 is transported, can be prevented.

Although in the first and second embodiments a description has been given of a case where one pair of springs 50 are provided, only one spring 50 may be used, or three or more springs 50 may be provided across an entire transverse width of the retard plate opposing the outer peripheral surface of the separation roller 44.

In addition, although in the first and second embodiments the entire springs 50 are formed of members having a small coefficient of friction, a member having a small coefficient of friction may be attached to the separation roller 44 side of each spring 50. Furthermore, although paper having a thickness ranging from 0.05 to 0.09 mm is used as the documents 56, the present invention is applicable to paper having a thickness ranging from 0.03 to 0.20 μm. Although paper whose weight per square meters ranges from 30 to 60 g is used as the documents 56, paper whose weight does not fall within range may be used.

Figure 7:
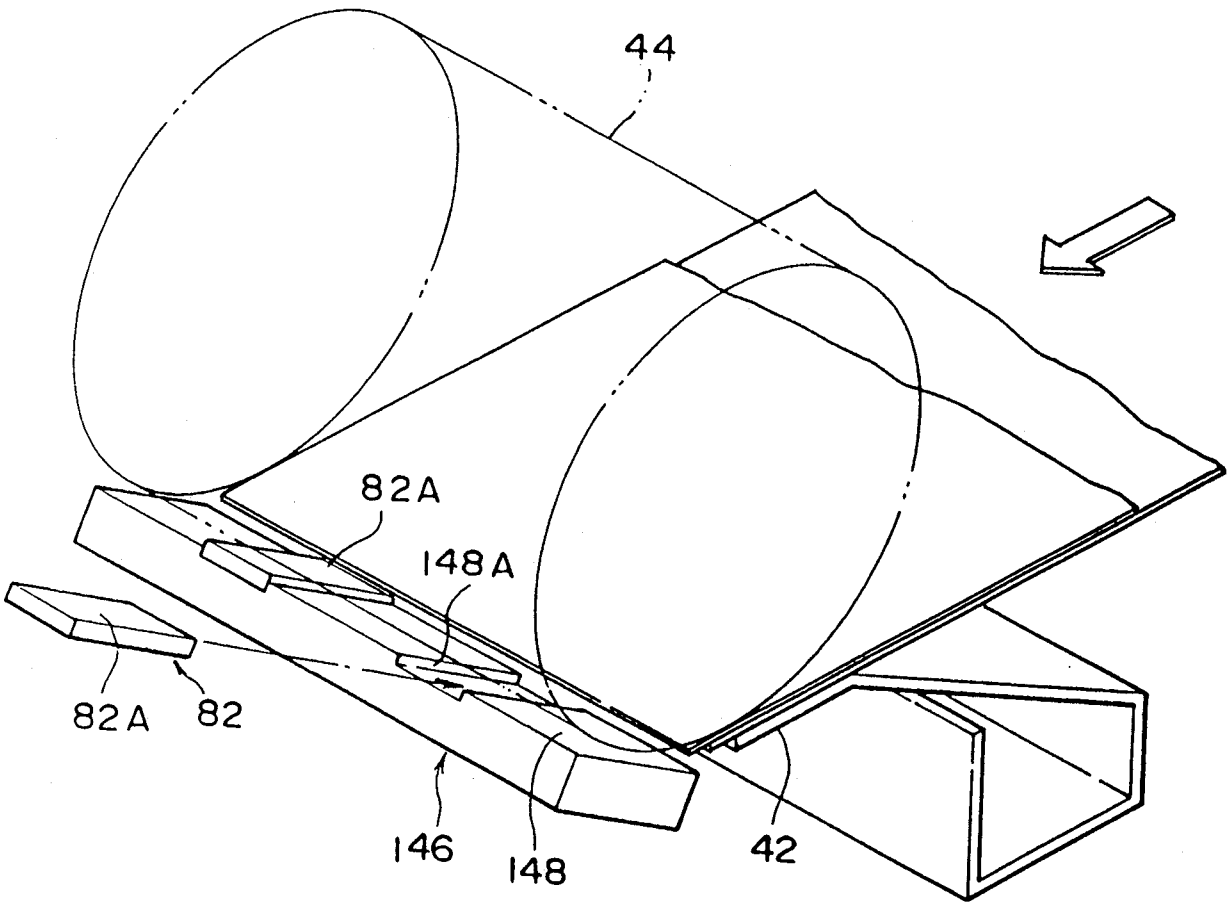
FIG. 7 is a perspective view of a third embodiment of the present invention.

Referring now to FIG. 7, a description will be given of a third embodiment of the present invention.

In the same way as in the first embodiment, a pair of grooves 148A are formed in an opposing surface 148 opposing the separation roller 44 are formed in a retard plate 146. A stretchable, rectangular and soft material 82 is secured in each of the grooves 148A. This soft material 82 is formed of a material having a smaller frictional resistance than that of the retard plate 146. Each soft material 82 has a pressing surface 82A opposing the separation roller 44. In a state in which only one document 56 is inserted into nips between the pressing surfaces 82A and the separation roller 44, the pressing surfaces 82A project toward the separation roller 44. Meanwhile, in the event that a plurality of documents 56 tend to be inserted into the nips between the separation roller 44 and the pressing surfaces 82A opposing the separation roller 44, the soft materials 82 are pressed and compressed by these documents 56, so that the pressing surfaces 82A retract away from the separation roller 44 below the opposing surface 148 of the retard plate 146.

A brief description will now be given of the operation of this embodiment.

In a state in which the documents 56 are fed one by one, the document 56 is transported by the rotation of the separation roller 44 in a state in which the document 56 is brought into contact with the pressing surfaces 82A projecting from the opposing surface 148, i.e., in a state in which the document 56 is floating above at least a portion of the retard plate 146. Since the frictional resistance of the pressing surfaces is made small, the document 56 is transported satisfactorily without a large resistance being imparted thereto.

Meanwhile, in a case where a plurality of (e.g. two) documents 56 are fed in a superposed state into nips between the separation roller 44 and the pressing surfaces 82A, the pressing surfaces 82A retract into the grooves 148A, i.e., reach a position where they do not project above the opposing surface 148. Accordingly, the surface of the lower one (on the retard plate 146 side) of the two documents 56 fed in the superposed state is brought into contact with the opposing surface 148 having a large frictional resistance. Hence, the transport of the lower one of the two superposed documents 56 is hampered, so that only the upper one of the documents 56 is transported by the rotation of the separation roller 44. This document 56 is transported in the same way as in the above-described embodiments, and is discharged onto the discharge table 15. When the upper one of the documents 56 is transported and disappears from the pressing surfaces 82A, the pressing surfaces 82A project above the opposing surface 148, and at least a portion of the surface of an ensuing document 56 assumes a state in which it does not abut against the retard plate 146, so that the document 56 can be transported in a satisfactory manner.

In this embodiment as well, in the same way as the foregoing embodiments, since the document 56 is brought into pressure contact with the separation roller 44 and is transported by means of the soft materials 82 having a small frictional resistance without setting the gap between the retard plate 146 and the separation roller 44 depending on the thickness of the documents 56, documents having varying thicknesses can be reliably separated and transported one by one.

Furthermore, in accordance with the third embodiment of the present invention, since the transverse ends of the sheet material is nipped by the pressing plates and the retarding member, and the sheet material is transported with creases and the like at the ends thereof stretched, it is possible to obtain the advantage that the overlapped feeding can be prevented and the wrapping of the sheet material around the separation roller can be prevented.

Referring now to FIGS. 8 to 12, a description will be given of a fourth embodiment of the present invention.

Figure 8:
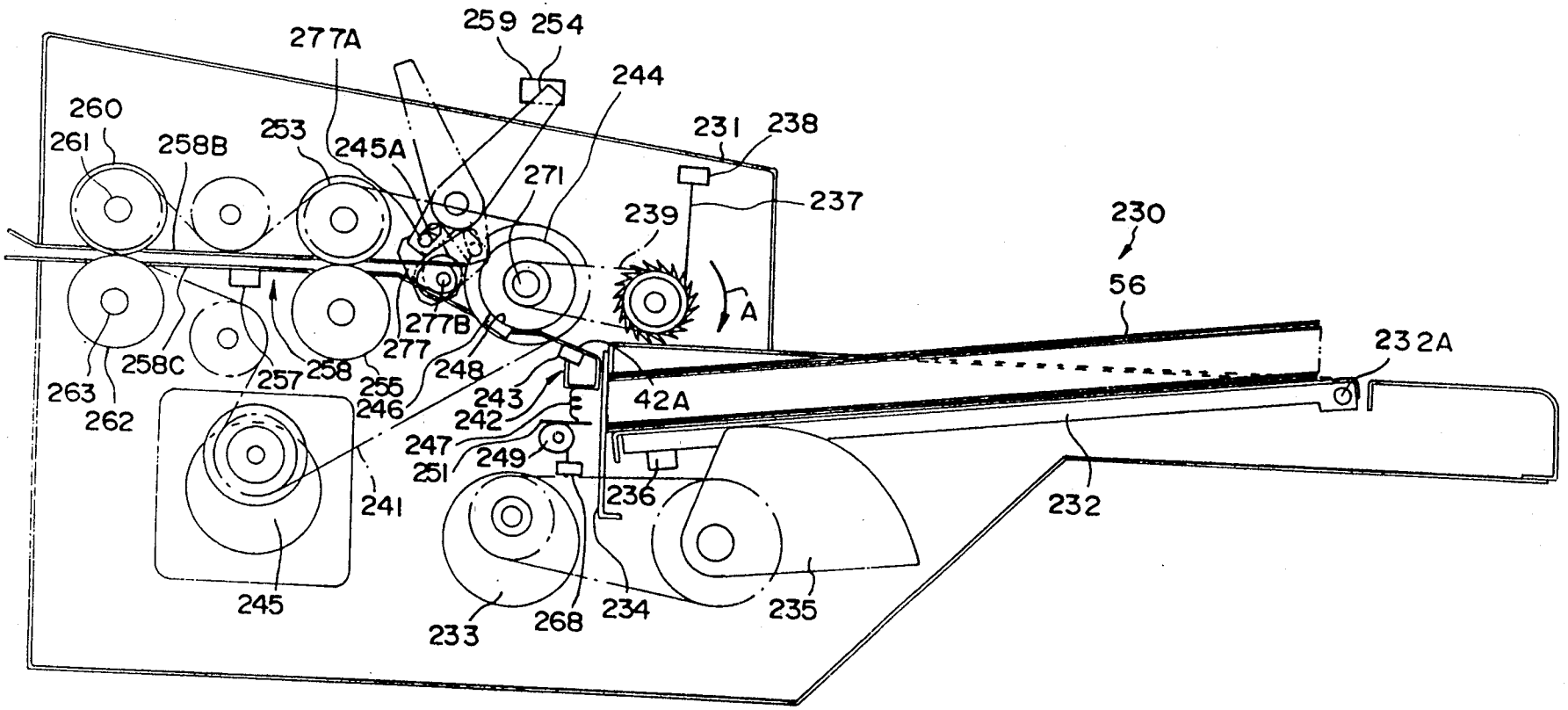
FIG. 8 is a schematic diagram of a sheet-material feeder in accordance with a fourth embodiment.

FIG. 8 shows a schematic diagram of a sheet-material feeder 230 in accordance with the fourth embodiment.

Figure 9:
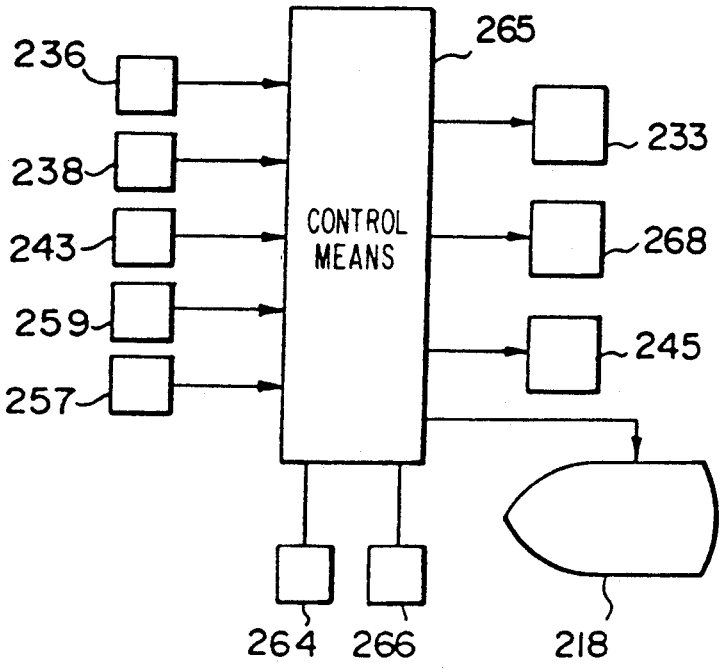

A hopper 232 having one end (proximal end) supported rotatably about a horizontal shaft 232 is disposed within a cover 231 of the sheet-material feeder 230. The hopper 232 is operated by a cam 235, driven by a motor 233, to rotate about the shaft 232A between an inclined position (a position in which the paper-placing surface of the hopper 232 is inclined) and a horizontal position. As shown in FIG. 9, the motor 233 is connected to a controller 265. The sheet-material feeder 230 is provided with an unillustrated start key, and by operating the start key, the motor 233 can be operated.

As shown in FIG. 8, a stopper 234 is disposed substantially vertically at the other end of the hopper 232. The plurality of documents (sheet material) 56 are mounted in the hopper 232 with their leading ends abutting against the stopper 234.

A document detection sensor 236 is disposed on an underside (a surface opposite to the surface for placing the documents 56) of the hopper 232. In this embodiment, a reflection-type photo-interrupter is used as the document detection sensor 236, and the light emitted by a light-emitting element constituting the photo-interrupter is arranged to pass through a through hole (not shown) formed in the hopper 232. Accordingly, it is possible to detect whether or not the documents 56 have been set in the hopper 232. An output of the document detection sensor 236 is inputted to the controller 265. A positioning sensor, though not shown, is disposed below the hopper 232, and the arrangement provided is such that when the hopper 232 is rotated downward by a predetermined amount, the operation of the motor 233 is stopped.

A prefeed roller 240 is disposed above a distal end of the hopper 232. The prefeed roller 240 is accommodated in elongated holes (not shown) which are respectively formed in a pair of support plates (not shown) with opposite ends of their shaft portions secured to the cover 231, and whose longitudinal direction is set vertically. The prefeed roller 240 is vertically movable by means of a solenoid controlled by the controller 265. In addition, the prefeed roller 240 is provided with a moving plate 237. A positioning sensor 238 is disposed above the prefeed roller 240.

In this embodiment, a limit switch is used as the positioning sensor 238, and the limit switch is turned off when it is pressed by a distal end of the moving plate 237 which is moved upward together with the prefeed roller 240. With the positioning sensor 238 turned off, an uppermost one of the documents 56 set in the hopper 232 reaches the paper feeding position. In this paper feeding position, the uppermost one of the documents 56 abuts against the outer peripheral surface of the prefeed roller 240, and is transported downstream by the prefeed roller 240 which is rotated in the direction of arrow A in FIG. 8 (clockwise in FIG. 8) by a mechanism which will be described later. As shown in FIG. 9, an output of the the positioning sensor 238 is inputted to the controller 265.

A guide plate 242 is disposed on the downstream side, as viewed in the traveling direction of the documents 56, of the hopper 232, i.e., the prefeed roller 240. This guide plate 242 differs from the guide plate 42 only in that a through hole (not shown) is formed in its plate-like portion 242A. A separation roller 244 is disposed in correspondence with an upper surface of the plate-like portion 242A of this guide plate 242. This separation roller 244 is coupled with a motor 245 via a separation roller clutch 271.

A cam 277 having a pin 277A and supported rotatably about a pin 277B is disposed on an outer peripheral surface of the separation roller 244 downstream, as viewed in the traveling direction of the documents 56, of a lowermost portion of that outer peripheral surface. A changeover knob 254 is disposed inside the cover 231 in a state in which one end thereof projects outside the cover 231. A slot 245A is formed in an end of the changeover knob 254 on the separation roller 244 side, and the pin 277A is inserted in this slot 245A. The cam 277 is arranged such that as the changeover knob 254 is rotated counterclockwise in FIG. 8, the cam 277 is rotated to allow the outer peripheral surface of the separation roller 244 to be pressed by the outer peripheral surface of the cam 277. A mode detection sensor 259 is disposed at a distal end of the changeover knob 254, which is on the upper side in FIG. 8. A reflection-type photo-interrupter is used as the mode detection sensor 259, which is turned off when the changeover knob 254 is at the position indicated by the solid line in FIG. 8, and turned on when it is at the position indicated by the two-dotted dash line.

The separation roller 244 is coupled with the prefeed roller 240 via an endless belt 239. In addition, the separation roller 244 is coupled with the motor 245 via an endless belt 241, and is driven by the motor 245 in a state in which the aforementioned separation roller clutch 271 is turned on. When the separation roller 244 is rotated, the torque of the separation roller 244 is transmitted to the prefeed roller 240 via the belt 239, so as to rotate the prefeed roller 240.

A transport detection sensor 243 is disposed on an underside of the plate-like portion 242A of the guide plate 242 in correspondence with the aforementioned through hole (not shown) formed in the plate-like portion 242A. A reflection-type photo-interruper is used as the transport detection sensor 243. The light emitted from a light-emitting element constituting the photo-interrupter is arranged to pass through the through hole (not shown) formed in the plate-like portion 242A. Accordingly, it is possible to detect the document 56 being transported on the plate-like portion 242A.

In addition, one end of a spring member 247 is fixed to an underside of a proximal portion of the guide plate 242. The other end of the spring member 247 is fixed to an upper surface of a plate-like member 251. An outer peripheral surface of a cam 249 abuts against an underside of the plate-like member 251. The cam 249 is driven by a solenoid 268 whose operation is controlled by the controller 265. Accordingly, an interval between the separation roller 244 and the plate-like portion 242A of the guide plate 242, i.e., the pressing force of the document 56 with respect to the separation roller 244 by means of the guide member 242A, can be adjusted. The arrangement provided is such that as an unillustrated adjusting switch is operated, the interval between the separation roller 244 and and the plate-like member 242A of the guide plate 242 can be varied in correspondence with the paper quality of the documents 56.

A retard plate 246 is disposed on the downstream side, as viewed in the traveling direction, of the guide plate 242. The arrangement of this retard plate 246 is identical with that of the retard plate 46 of the first embodiment. That is, for instance, the retard plate 246 has an opposing surface 248 opposing the separation roller 244, and a pair of grooves are formed in the retard plate 246, a pair of springs (see FIGS. 3 and 4) being disposed in the grooves, respectively. Accordingly, with respect to the grooves and the springs of the retard plate 246, a description will be given by using the reference numerals used in FIGS. 3 and 4 for the first embodiment.

A guide section 258 is disposed in the vicinity of the separation roller 244 on the downstream side thereof as viewed in the traveling direction. This guide section 258 includes an upper plate 258B and a lower plate 258C. The guide section 258 extends toward a paper feeding section of an unillustrated rotary camera for microfilm photographing. A downstream end, as viewed in the traveling direction, of the guide section 258 is inserted into the paper feeding section of the unillustrated rotary camera for microfilm photographing.

A pair of transport rollers 253 and 255 are supported rotatably at an intermediate portion of the guide section 258. The torque of the motor 245 is transmitted to the transport roller 253 via the aforementioned endless belt 241.

A transport detection sensor 257 constituted by a reflection-type photo-interrupter is disposed on an underside of the aforementioned lower plate 258 on the downstream side, as viewed in the traveling direction, of the transport rollers 253 and 255. The transport detection sensor 257 is arranged such that the light emitted from a light-emitting element constituting the photo-interrupter passes through a through hole (not shown) formed in the lower plate 258C. As a result, the presence or absence of the document 56 in the guide section 258 can be detected.

Figure 12:
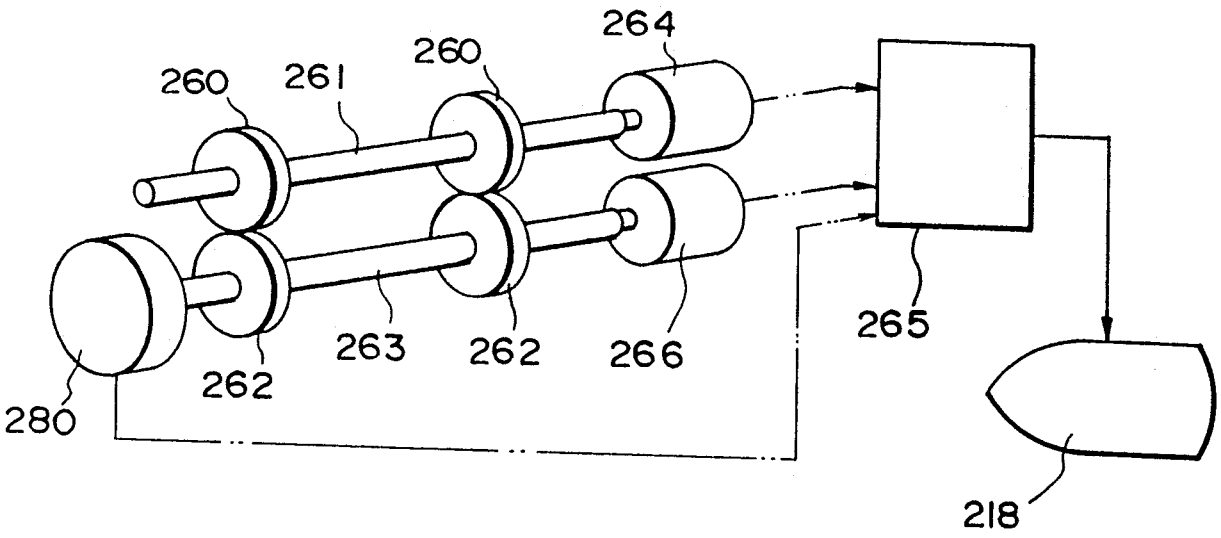
FIG. 12 is a perspective view illustrating an overlapped-feeding detection mechanism.
Figure 13:
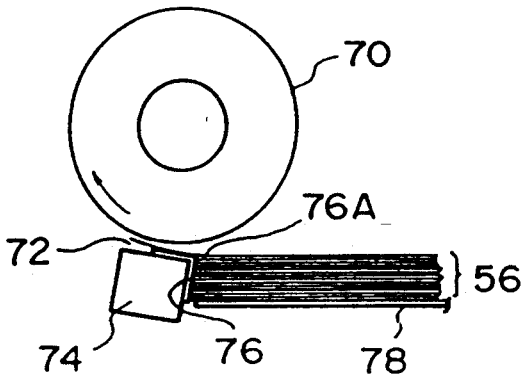
FIG. 13 PRIOR ART
FIG. 13 is a side elevational view of a conventional automatic sheet-material feeder.

As also shown in FIG. 12, the guide section is provided with a pair of drive rollers 260 and a pair of driven rollers 262 which are respectively supported on a drive shaft 261 and a driven shaft 263 arranged in parallel with each other on the downstream side, as viewed in the traveling direction, of the transport detection sensor 257.

As shown in FIG. 8, the torque of the motor 245 is transmitted to the drive rollers 260 via the endless belt 241 so as to rotate the drive roller 260 clockwise in FIG. 8. Meanwhile, in a state in which the document 56 is nipped by the driven rollers 262 and the drive rollers 260, the torque of the driven rollers is transmitted to the driven rollers 262 via the document 56, so as to rotate the driven rollers 262 counterclockwise in FIG. 8. Accordingly, in the state in which a single document 56 is being nipped thereby, the rotational speed of the driven rollers 262 is substantially equal to the rotational speed of the drive rollers 260.

An encoder 264 for converting the rotational speed of the drive rollers 260 to a corresponding pulse train and outputting the same to the controller 265 is disposed at one end the drive shaft 261. In addition, an encoder 266 for converting the rotational speed of the driven rollers 262 to a corresponding pulse train and outputting the same to the controller 265 is disposed at one end of the driven shaft 263. Furthermore, an electric brake 280 is disposed at a tip of the driven shaft 263, and the arrangement provided is such that when the electric brake 280 is turned on, a brake can be applied to the driven shaft 263. The electric brake 280 is controlled by the controller 265 in such as manner as to be turned on when the document 56 reaches the driven rollers 262 and the drive rollers 260. The aforementioned drive rollers 260, the driven rollers 262, and the encoders 264 and 266 constitute overlapped-feeding detecting means. This overlapped-feeding detecting means is provided by taking into consideration special cases in which the overlapped feeding cannot be prevented for some reason or other by means of the separation roller 244 and the retard plate 246. In addition, as shown in FIG. 12, a display unit 218 for displaying an occurrence of the overlapped feeding of a plurality of documents 56 is connected to the controller.

A brief description will be given hereafter of detection of an overlapped feeding by means of the overlapped-feeding detecting means.

The document 56 introduced to the guide section 258 is transported in a state in which it is nipped by the drive rollers 260 and the driven rollers 262. When the document 56 reaches the drive rollers 260 and the driven rollers 262, the electric brake is turned on, thereby applying a brake to the driven shaft 263. Outputs of the encoders 264 and 266 are received by the controller 265, and in a state in which the brake is being applied to the driven shaft 263, the controller 265 calculates a rotational speed $V_1$ of the drive rollers 260 and a rotational speed $V_2$ of the driven rollers 262. In addition, the controller 265 makes a comparison between $|V_1-V_2|$ and a predetermined value a. If $|V_1-V_2|$ is less than a, the aforementioned processing is repeated, and whether or not the documents 56 fed consecutively into the nips between the drive rollers and the driven rollers 262 are being fed in an overlapping state is detected. If the transport detection sensor 257 is turned on, the electrical brake 280 is turned off, and the comparison between $|V_1-V_2|$ and the predetermined value a ends. When the documents 56 are being transported one by one, the rotation of the drive rollers 260 is transmitted to the driven rollers 262 via the document 56, so that the driven rollers 262 rotates at a rotational speed substantially equal to that of the drive rollers 260. For this reason, $|V_1-V_2|$ becomes less than the predetermined value a. Meanwhile, if a plurality of documents 56 are superposed one top of each other, a brake is applied to the driven shaft 263, so that the documents 56 undergo slippage relative to each other, making it impossible to transmit the driving force to be imparted to the driven rollers 262. Hence, the overlapped feeding of the documents 56 can be prevented. The rotating force of the drive rollers 260 is hence not substantially transmitted to the lower one of the documents 56 and the driven rollers 262, so that the rotating force of the driven rollers 262 declines. For this reason, $|V_1-V_2|$ becomes greater than or equal to the predetermined value a, and when it is determined that $|V_1-V_2|$ has become greater than the predetermined value a, a determination is made that the superposed documents 56 have been offset. Then, a display is given on the display unit 218 to the effect that an overlapped feeding has occurred.

The operation of this embodiment will be described hereafter.

In this embodiment, an automatic feeding mode or a manual feeding mode can be set in correspondence with the paper quality and the like by operating the changeover knob 254.

Figure 10A:
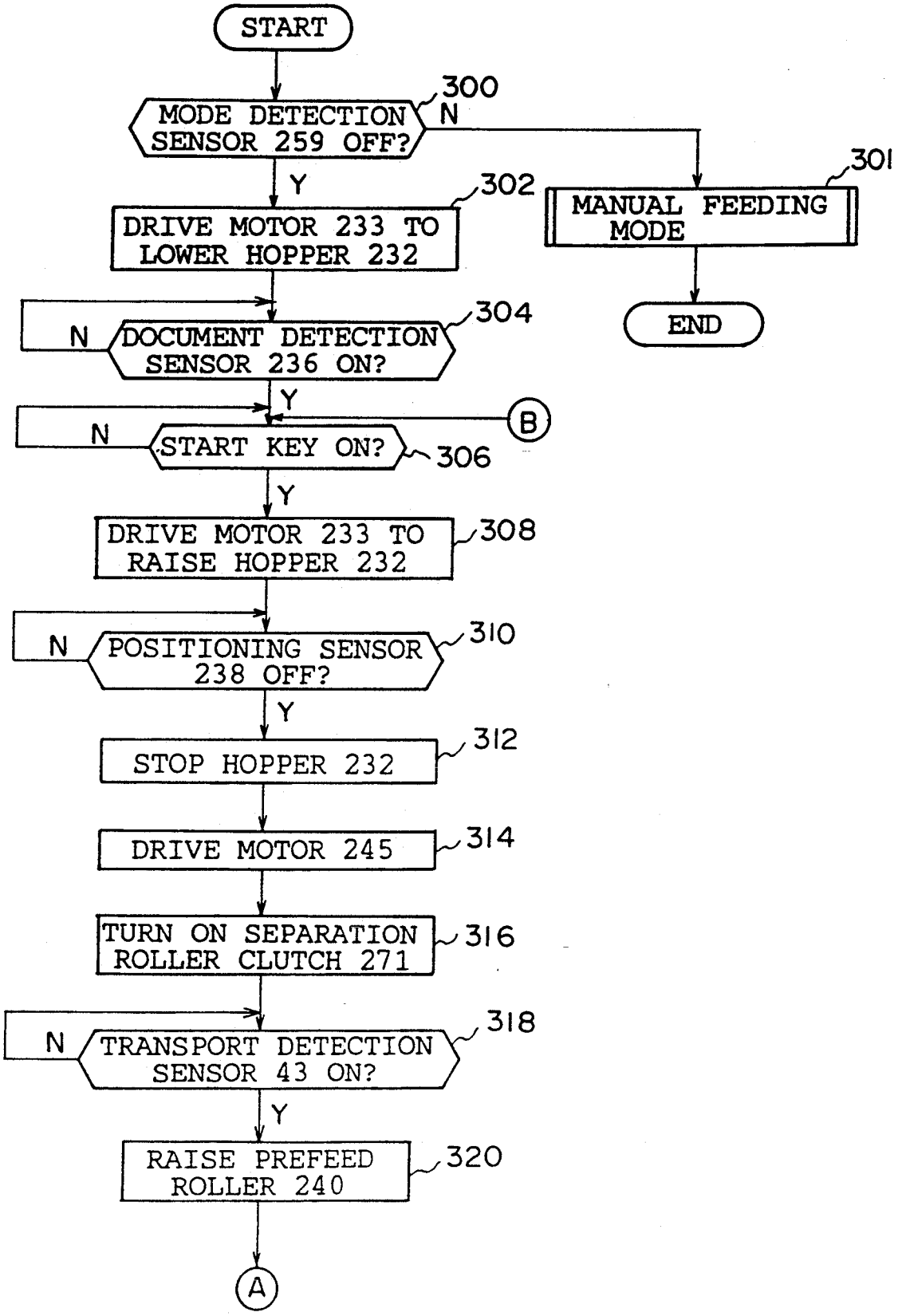
FIGS. 10A and 10B are flowcharts illustrating the operation of an automatic feeding mode.
Figure 10B:
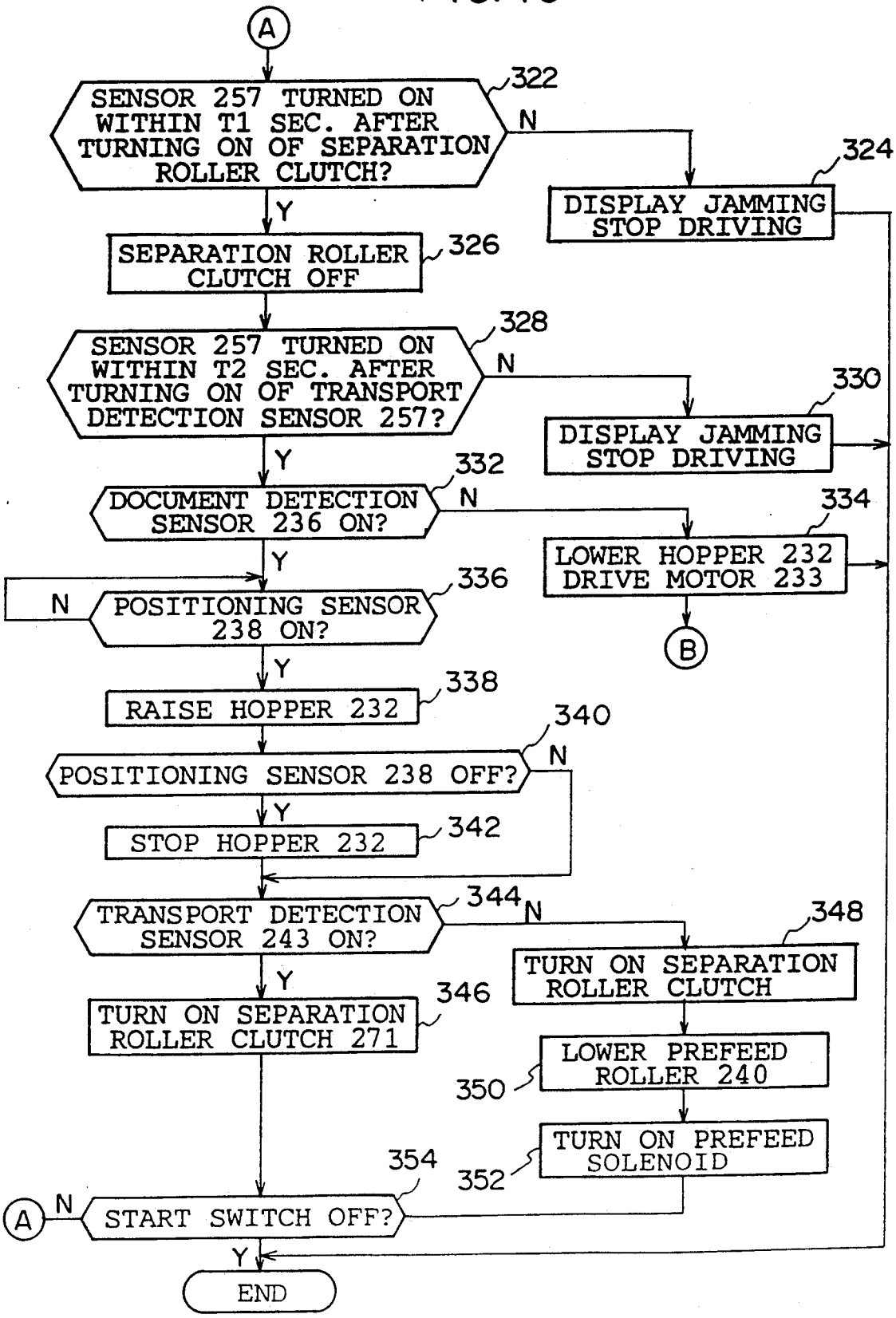
Figure 11:
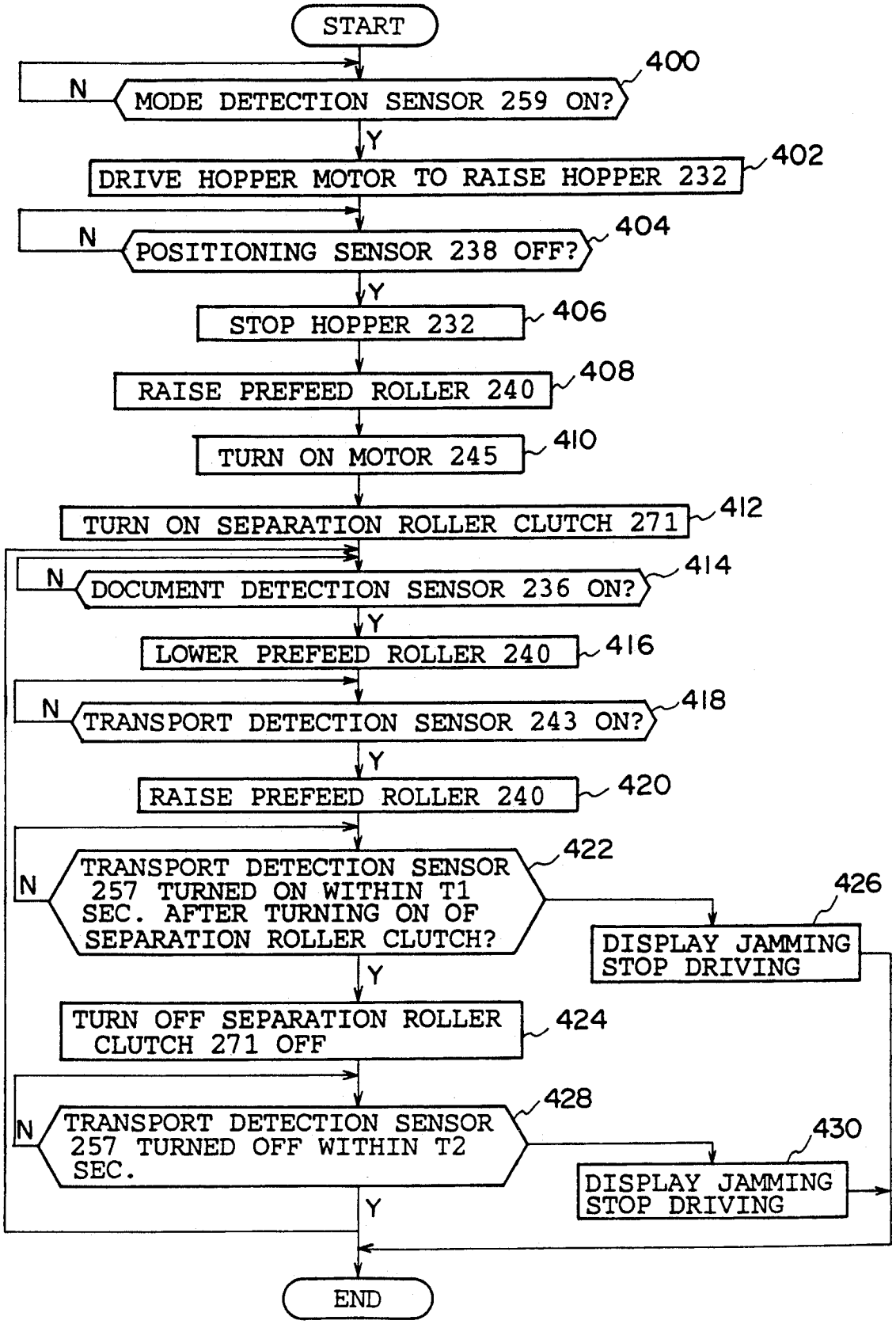
FIG. 11 is a flowchart illustrating a manual feeding mode.

Referring to flowcharts shown in FIGS. 10A and 10B, a description will be given of the automatic feeding mode.

If the changeover knob 254 is rotated counterclockwise in FIG. 8, the separation roller 244 moves along the unillustrated grooves in such a manner that the outer peripheral surface of the separation roller 244 approaches the opposing surface 248 of the retard plate 246. As a result, the interval between the separation roller 244 and the document-pressing surfaces 50D (see FIG. 4) of the pair of springs is set within a range of 0.00–0.003 mm. This range is such a range that, even if a plurality of documents 56 are present between the separation roller 244 and the retard plate 246 at the time of automatically feeding the documents 56 each having a thickness of 0.05 to 0.09 mm, one document can be separated from the others.

In Step 300, a determination is made as to whether or not the mode detection sensor 259 has been turned off, i.e., whether or not the automatic feeding mode has been set. If it is determined that the mode detection sensor 259 has been turned off, in Step 302, the motor 233 is controlled so that the hopper 232 is lowered to a predetermined position. As a result, the documents 56 can be set in the hopper 234. If it is determined that the mode detection sensor 259 has not been turned off, the manual feeding mode which will be described later is executed in Step 301. In addition, as the unillustrated changeover switch is changed over as necessary, the solenoid 268 is controlled in such a manner that the document 56 is pressed against the outer peripheral surface of the separation roller 244 by the plate-like portion 242A of the guide plate 242 with an optimum pressing force corresponding to the paper quality of the documents 56. If the surface of the documents 56 has a high frictional resistance, as in the case of pressure sensitive paper, the pressing force is preferably set to approximately 150 g. Meanwhile, in the case of plain paper or thick paper, it is preferable to set the pressing force to 400 g or thereabouts higher than for pressure sensitive paper or the like. As a result, the documents 56 can be transported smoothly.

In addition, in Step 304, a determination is made as to whether or not the document detection sensor 236 has been turned on, i.e., whether or not the documents 56 have been set in the hopper 232. If it is determined that the document detection sensor 236 has been turned on, a determination is made in Step 306 as to whether or not the start key (not shown) has been turned on. If it is determined that the document detection sensor 236 is off, Step 306 is repeated. If it is determined in Step 306 that the start key has been turned on, the motor 233 is controlled so that the hopper 232 is raised.

Next, a determination is made in Step 310 as to whether or not the positioning sensor 238 has been turned off, i.e., whether or not the uppermost one of the documents 56 set in the hopper 232 is located at the feeding position. If it is determined that the positioning sensor 238 has been turned off, the movement of the hopper 232 is stopped in Step 312, and if it is determined that the positioning sensor 238 has been turned on, Step 310 is repeated.

Then, in Step 314, the motor 245 is driven, with the result that the separation roller 244, the transport rollers, and the drive rollers 260 are rotated clockwise in FIG. 8. In addition, in Step 316, the separation roller clutch 271 is turned on by slightly lagging behind the driving of the motor 245 to rotate the prefeed roller 240 clockwise in FIG. 8. As a result, the uppermost one of the documents 56 is transported by the prefeed roller 240.

In Step 318, a determination is made as to whether or not the transport detection sensor 243 has been turned on, i.e., whether or not the leading end of the document 56 transported has passed the transport detection sensor. If it is determined that it has been turned on, in Step 320, the unillustrated solenoid is controlled in such a manner as to raise the prefeed roller 240 after the lapse of a predetermined time, i.e., after the leading end of the document 56 has been transported to the position of the gap by the prefeed roller 240. As a result, the apparatus is set in a state in which an ensuing document 56 is not transported. Since the ensuing document is not transported when the document 56 is already at the position of the gap, the overlapped feeding of the documents 56 can be controlled. When it is determined that the transport detection sensor 243 is off, Step 318 is repeated until the leading end of the document 56 is detected.

In Step 322, a determination is made as to whether or not the transport detection sensor 257 has been turned on within a T1 second after the separation roller clutch 271 was turned on. If it is determined that the transport detection sensor 257 has not been turned on, it means that a jamming has occurred, so that, in Step 324, the jamming is displayed and the driving of the motor 245 is stopped. If it is determined that the transport detection sensor 257 has been turned on, i.e., if it is determined that the documents 56 are being transported satisfactorily without the occurrence of a jamming, the separation roller clutch 271 is turned off in Step 326. Accordingly, the rotation of the prefeed roller 240 is stopped, so that an ensuing one of the documents 56 is not transported.

Next, in Step 328, a determination is made as to whether or not the transport detection sensor 257 has been turned off within a T2 second. If it is determined that the transport detection sensor 257 has not been turned off within the T2 second, it means that a jamming has occurred, so that, in Step 330, the jamming is displayed and the driving of the motor 245 is stopped. If it is determined that the transport detection sensor 257 has been turned off within the T2 second, a determination is made in Step 332 as to whether or not the document detection sensor 236 has been turned on, i.e., whether or not any document 56 is present in the hopper 232. If it is determined that the document detection sensor 236 has been turned off, there is no longer any document 56 to be transported newly by the prefeed roller 240, the motor 233 is controlled in Step 334 to lower the hoper 232 to set the apparatus in a condition allowing the documents 56 to be set, and the operation then returns to Step 304.

Meanwhile, if it is determined that the document detection sensor 236 has been turned on, a determination is made in Step 336 as to whether or not the positioning sensor 238 has been turned on, i.e., whether or not an uppermost one of the documents 56 is present at the feeding position. If it is determined that the positioning sensor 238 has been turned on, in Step 338, the motor 233 is controlled in such a manner that the hopper 232 is raised to allow the uppermost one of the documents 56 to reach the feeding position. If it is determined that the positioning sensor 238 has been turned off, Step 336 is repeated.

Next, in Step 340, a determination is made as to whether or not the positioning sensor 238 has been turned off, i.e., whether or not the uppermost one of the documents 56 is positioned at the feeding position. If it is determined that the positioning sensor 238 has been turned off, in Step 342, the driving by the motor 233 is stopped to stop the upward movement of the hopper 232. If it is determined that the positioning sensor 238 has been turned on, a determination is made in Step 344 as to whether or not the transport detection sensor 243 has been turned on.

If it is determined in Step 344 that the transport detection sensor 243 has been turned on, it means that one or more documents 56 which are located immediately below the relevant document 56 have also been transported owing to the transport of that document 56, so that the unillustrated solenoid is controlled in Step 346 so that the raised condition of the prefeed roller 240 will not be maintained. In addition, the separation roller clutch 271 is turned on, and Steps 322 to 346 are repeated. If it is determined that the transport detection sensor 243 has been turned off, i.e., if one or more documents which are located immediately below the relevant document 256 have not been transported owing to the transport of that document 256, the separation roller clutch 271 is turned on in Step 348. In addition, in Step 350, the unillustrated solenoid is controlled to lower the prefeed roller 240. As a result, the document 56 is transported toward the separation roller 244. In Step 352, the unillustrated solenoid is controlled to raise the prefeed roller 240, i.e., to prevent an ensuing one of the documents 56 from being transported. Next, in Step 354, a determination is made as to whether or not the unillustrated start key has been turned off. If it is determined that the start key has not been turned off, the operation returns to Ste 322, and if it is determined that the start key has been turned off, the processing ends.

In the above-described automatic feeding state, in a state in which the documents 56 are being fed one by one, the document 56 is transported to the guide section 258 by the rotation of the separation roller 244 in a state in which the document 56 is made to abut against the pressing surfaces 50D (see FIG. 4 illustrating the first embodiment) of the springs projecting from the opposing surface 248 of the retard plate 246, i.e., in a state in which the document 56 is floating from the retard plate 246. In this case, since the frictional resistance of the pressing surfaces 50D of the springs is made small, the document 56 is transported satisfactorily without a large resistance being imparted thereto.

In addition, since the document 56 is transported while being pressed against the separation roller 244 by the resiliently deformable portions 50C (see FIG. 4 illustrating the first embodiment) of the springs, creases and the like are stretched. As the prefeed roller 240 rotates, the uppermost one of the documents 56 placed in the hopper 232 is fed into a nip between the separation roller 244 and the resiliently deformable portions 50C (see FIG. 4 illustrating the first embodiment) of the springs while being guided by the guide plate 242. In this case, even if the documents 56 having varying thicknesses are fed consecutively one by one, the resiliently deformable portions 50C undergo resilient deformation, so that the document 56 is brought into pressure control with the separation roller 244 by the resiliently deformable portions 50C. Accordingly, the documents 56 having varying thicknesses can be transported respectively without needing to adjust the gap between the separation roller 244 and the opposing surface of the retard plate 246.

The document 56 introduced to the guide section 258 is transported while being nipped by the drive rollers 260 and the driven rollers 262, and is fed to the unillustrated rotary camera for microfilm photographing, or the like.

Meanwhile, in the event that a plurality of (e.g. two) documents 56 transported from the hopper 232 are fed in a superposed state into nips between the separation roller 244 and the resiliently deformable portions 250C (see FIG. 4 illustrating the first embodiment), the resiliently deformable portions 50C retract into the grooves 48A (see FIGS. 3 and 4 illustrating the first embodiment) of the retard plate 246 owing to the pressing force of these documents 56, so that the pressing surfaces 50D (see FIG. 4 illustrating the first embodiment) of the springs reach a position where they do not project from the opposing surface 248 of the retard plate 246. Accordingly, the surface of the lower one (on the retard plate 246 side) of the documents 56 fed in the superposed state is brought into contact with the opposing surface 248 of the retard plate 246 having a large frictional resistance. Accordingly, the transport of the lower one of the two documents 56 fed in the superposed state is hampered, and only the upper one of the documents 56 is transported by the transporting force of the separation roller 244.

The document 56 thus transported is further transported in the same manner as described before, and is discharged onto a discharge table (not shown) which is similar to the discharge table 15 of the first embodiment. When the upper one of the documents 56 is transported and ceases to be located on the pressing surfaces 50D, the pressing surfaces 50D (see FIG. 4 illustrating the first embodiment) project from the opposing surface 248. Hence, the condition becomes such that the surface of the remaining document 56 which was fed in the superposed state does not abut against the retard plate 246, so that this document 56 is transported satisfactorily.

Next, a description will be given of the manual feeding mode.

When thick documents with a thickness of 0.15 mm or more, thin documents with a thickness of 0.04 mm or less, or documents in which folds, creases or the like are present, are fed, the changeover knob 254 is rotated clockwise in FIG. 8. As a result, the separation roller 244 is moved along the unillustrated grooves in such a manner that its outer peripheral surface away from the opposing surface 248 of the retard plate 246, and the interval between the separation roller 244 and the retard plate 246 is set in a range of 0.5 to 1.0 mm. In the manual feeding mode, the operator sets the documents 56 one by one in the hopper 232.

In Step 400, a determination is made as to whether or not the mode detection sensor 259 has been turned on, i.e., whether or not the manual feeding mode has been set. If it is determined that the mode detection sensor 259 has been turned on, in Step 402, the motor 233 is controlled to raise the hopper 232 and to set the paper-placing surface horizontal. Meanwhile, if it is determined that the mode detection sensor 259 has been turned off, Step 402 is repeated.

In Step 404, a determination is made as to whether or not the positioning sensor 238 has been turned off, i.e., whether or not the document 56 will reach the feeding position when one document 56 is set in the hopper 232. In this embodiment, the positioning sensor 238 is turned off with the paper-placing surface of the hopper 232 set horizontal. If it is determined that the positioning sensor 238 has been turned off, the hopper 232 is stopped in Step 406. Next, the unillustrated solenoid is controlled in Step 408 to raise the prefeed roller 240. In Step 410, the motor 245 is turned on. As a result, the drive rollers 260 and the transport roller 253 are rotated. In addition, in Step 412, the separation roller clutch 271 is turned on, with the result that the driving force of the motor 245 is transmitted to the separation roller 244, thereby rotating the separation roller 244.

Next, in Step 414, a determination is made as to whether or not the document detection sensor 236 has been turned on, i.e., whether or not the document 56 has been manually set in the hopper 232. If it is determined that the document detection sensor 236 has been turned on, the unillustrated solenoid is controlled in Step 416 to lower the prefeed roller 240. As a result, the document 56 is transported by the prefeed roller 240.

In Step 418, a determination is made as to whether or not the transport detection sensor 234 has been turned on, i.e., whether or not the leading end of the transported document 56 has passed the transport detection sensor 243. If it is determined that the transport detection sensor 234 has been turned on, after the lapse of a predetermined time the unillustrated solenoid is controlled in Step 420 to lower the prefeed roller 240. If it is determined that the transport detection sensor 243 has been turned off, Step 418 is repeated.

Next, in Step 422, a determination is made as to whether or not the transport detection sensor 257 has been turned on within the T1 second after the separation roller clutch 271 was turned on. If it is determined that the transport detection sensor 257 has been turned on within the T1, the separation roller clutch 271 is turned off in Step 424 to stop the transport of an ensuring document 56. Meanwhile, if it is determined that the transport detection sensor 257 has been turned off, it means that a jamming has occurred, so that, in Step 426, the jamming is displayed and the driving of the motor 245 is stopped.

In Step 428, a determination is made as to whether or not the transport detection sensor 257 has been turned off within the T2 second, i.e., whether or not a jamming has occurred. If it is determined that the transport detection sensor 257 has been turned off, Steps 414 to 428 are repeated. Meanwhile, if it is determined that the transport detection sensor 257 has been turned on, in Step 430, the jamming is displayed and the motor 245 is stopped. It should be noted that in a case where a plurality of documents 56 are inserted into a nip between the separation roller 244 and the retard plate 246, the documents 56 can be fed only one at a time to the unillustrated rotary camera for microfilm photographing or the like, as described above.

By virtue of the above-described arrangement, since the automatic feeding mode and the manual feeding mode can be set in the above-described fourth embodiment, even thin documents 56 or paper in which folds, creases or the like are present can be fed to a predetermined feeding section satisfactorily by preventing the overlapped feeding.

Furthermore, in the fourth embodiment, the feeding of the documents 56 is effected more smoothly since the solenoid is controlled in such a manner that the guide plate 242 is brought into proximity to and move away from the outer peripheral surface of the separation roller 244, and the document 56 is pressed against the outer peripheral surface of the separation roller 244 with a pressing force corresponding to the paper quality.

It should be noted that although in the fourth embodiment the automatic feeding mode and the manual feeding mode are changed over by moving the separation roller 244, an arrangement may be alternatively provided such that the retard plate 246 is disposed in such a manner as to be capable of being brought into proximity to and move away from the outer surface of the separation roller 244, and by moving the retard plate 246, the automatic feeding mode and the manual mode are changed over.

In addition, an arrangement may be provided such that after the lapse of a predetermined time upon detection of a trailing end of the document 56 sent earlier by the transport detection sensor 257, the separation roller clutch 271 is turned on, and an ensuing one of the documents 56 is then transferred. If this arrangement is adopted, an interval between two succeeding documents 56 which are transported can be fixed irrespective of the size of the documents 56.

Although the driving of the motor 245 is stopped when a jamming has occurred, the driving of the motor 245 may be stopped also when the overlapped feeding has occurred.

We claim:

1. A sheet-material transporting device, comprising:

roller means which is rotated in a predetermined direction;

retarding means having an opposing surface opposing said roller means in such a manner as to form a transport passage having a distance with respect to said roller means, said distance being set in correspondence with the thickness of a sheet material to be transported; and pressing means provided with a pressing surface projecting from said opposing surface toward said roller means and having a coefficient of friction smaller than that of said opposing surface, said pressing surface being adapted to press toward said roller means the sheet material inserted into a nip between said roller means and said retarding means, and said pressing surface being adapted to retract in a direction in which said pressing surface moves away from said roller means in correspondence with the thickness of the sheet material, wherein said pressing means is constituted by a soft member having said pressing surface and disposed in a groove formed in said opposing surface in such a manner that said pressing surface protects from said opposing surface.

2. A sheet-material transporting device according to claim 1, wherein at least one of said roller means and said retarding means is movable in such a manner that a distance between said roller means and said opposing surface is changeable.

3. A sheet-material transporting device according to claim 2, further comprising:

changing means for changing the distance by moving at least one of said roller means and said retarding means.

4. A sheet-material transporting device according to claim 1, further comprising:

transporting means for feeding a plurality of sheets of sheet material consecutively into said transport passage;

sensor means for detecting whether or not a leading end of the sheet material has been inserted into said transport passage; and control means for stopping the transport of an ensuing sheet of sheet material following a preceding sheet of sheet material by stopping the operation of said transporting means when it is detected by said sensor means that the preceding sheet of sheet material has been inserted into said transport passage.

5. The transporting device of claim 1, further comprising detecting means for detecting when sheet materials are fed in an overlapped manner.

6. The transporting device of claim 5, wherein said detecting means comprises:

a drive roller;

a driven roller driven by said drive roller, at least one of said sheet material being nipped between said drive roller and said driven roller;

drive means for driving said driven roller;

means for applying a partial braking force to said driven roller;

measuring means for measuring a difference in velocity between said drive roller and said driven roller when said at least one of said sheet materials is nipped therebetween, wherein when sheet materials are not overlapped said difference is below a predetermined value and wherein when said sheet materials are overlapped said difference is equal to or greater than said predetermined value.

7. A sheet-material transporting device, comprising:

roller means which is rotated in a predetermined direction;

retarding means having an opposing surface opposing said roller means in such a manner as to form a transport passage having a distance with respect to said roller means, said distance being set in correspondence with the thickness of a sheet material to be transported;

pressing means provided with a pressing surface projecting from said opposing surface toward said roller means and having a coefficient of friction smaller than that of said opposing surface, said pressing surface being adapted to press toward said roller means the sheet material inserted into a nip between said roller means and said retarding means, and said pressing surface being adapted to retract in a direction in which said pressing surface moves away from said roller means in correspondence with the thickness of the sheet material; and pressing and urging means for pressing portions of the sheet material located in the vicinity of transverse opposite ends of the sheet material against said opposing surface with an urging force when the sheet material is inserted into the nip between said roller means and said retarding means.

8. A sheet-material transporting device, comprising:

roller means which is rotated in a predetermined direction;

retarding means having an opposing surface opposing said roller means in such a manner as to form a transport passage having a distance with respect to said roller means, said distance being set in correspondence with the thickness of a sheet material to be transported;

pressing means provided with a pressing surface projecting from said opposing surface toward said roller means and having a coefficient of friction smaller than that of said opposing surface, said pressing surface being adapted to press toward said roller means the sheet material inserted into a nip between said roller means and said retarding means, and said pressing surface being adapted to retract in a direction in which said pressing surface moves away from said roller means in correspondence with the thickness of the sheet material;

pressure-contacting means disposed upstream of said pressing means and having a pressure-contacting surface opposing said roller means and adapted to bring the sheet material into pressure contact with said roller means before the sheet material is inserted into said transport passage.

9. A sheet-material transporting device according to claim 8, wherein said pressing means is constituted by a resilient member.

10. A sheet-material transporting device according to claim 9, wherein said retarding means has a recess in said opposing surface, and said resilient member is disposed in said recess in such a manner that said pressing surface projects from said opposing surface.

11. A sheet-material transporting device according to claim 10, wherein said resilient member is constituted by one of a spring member and a soft member whose size is reduced when said soft member is pressed.

12. A sheet-material transporting device according to claim 8, wherein said pressure-contacting means is movable in such a manner that the distance between said roller means and said pressure-contacting surface is changeable.

13. A sheet-material transporting device according to claim 12, further comprising:

changing means for changing the distance between said roller means and said pressure-contacting surface by moving said pressure-contacting means.

14. An automatic sheet-material feeder, comprising:

a separation roller which is rotated by driving means;

a retarding member having an opposing surface opposing said separation roller in such a manner as to form a transport passage having a distance with respect to said separation roller, said distance being set in correspondence with the thickness of a sheet material to be transported;

feeding means for feeding the sheet material into said transport passage; and pressing means provided with a pressing surface projecting from said opposing surface toward said separation roller and having a coefficient of friction smaller than that of said opposing surface, said pressing means being adapted to press toward said separation roller via said pressing surface the sheet material fed into a nip between said separation roller and said retarding member by said feeding means, and said pressing means being adapted to retract in a direction in which said pressing surface moves away from said separation roller in correspondence with the thickness of the sheet material, wherein said pressing means is constituted by a soft member having said pressing surface and disposed in a groove formed in said opposing surface in such a manner that said pressing surface protects from said opposing surface.

15. A automatic sheet-material feeder according to claim 14, wherein at least one of said separation roller and said retarding member is movable in such a manner that a distance between said separation roller and said opposing surface is changeable.

16. A automatic sheet-material feeder according to claim 15, further comprising:

changing means for changing the distance by moving at least one of said separation roller and said retarding member.

17. A automatic sheet-material feeder according to claim 14, wherein said feeding means is adapted to feed a plurality of sheets of sheet material consecutively into said transport passage, said automatic sheet-material feeder further comprising:

sensor means for detecting whether or not a leading end of the sheet material has been inserted into said transport passage; and control means for stopping the transport of an ensuing sheet of sheet material following a preceding sheet of sheet material by stopping the operation of said transporting means when it is detected by said sensor means that the preceeding sheet of sheet material has been inserted into said transport passage.

18. The transporting device of claim 14, further comprising detecting means for detecting when sheet materials are fed in an overlapped manner.

19. The transporting device of claim 18, wherein said detecting means comprises:

a drive roller;

a driven roller driven by said drive roller, at least one of said sheet material being nipped between said drive roller and said driven roller;

drive means for driving said driven roller;

means for applying a partial braking force to said driven roller;

measuring means for measuring a difference in velocity between said drive roller and said driven roller when said at least one of said sheet materials is nipped therebetween, wherein when sheet materials are not overlapped said difference is below a predetermined value and wherein when said sheet materials are overlapped said difference is equal to or greater than said predetermined value.

20. An automatic sheet-material feeder, comprising:

a separation roller which is rotated by driving means;

a retarding member having an opposing surface opposing said separation roller in such a manner as to form a transport passage having a distance with respect to said separation roller, said distance being set in correspondence with the thickness of a sheet material to be transported;

feeding means for feeding the sheet material into said transport passage;

pressing means provided with a pressing surface projecting from said opposing surface toward said separation roller and having a coefficient of friction smaller than that of said opposing surface, said pressing means being adapted to press toward said separation roller via said pressing surface the sheet material fed into a nip between said separation roller and said retarding member by said feeding means, and said pressing means being adapted to retract in a direction in which said pressing surface moves away from said separation roller in correspondence with the thickness of the sheet material; and pressing and urging means for pressing portions of the sheet material located in the vicinity of transverse opposite ends of the sheet material against said opposing surface with an urging force when the sheet material is fed into the nip between said separation roller and said retarding member.

21. An automatic sheet-material feeder, comprising:

a separation roller which is rotated by driving means;

a retarding member having an opposing surface opposing said separation roller in such a manner as to form a transport passage having a distance with respect to said separation roller, said distance being set in correspondence with the thickness of a sheet material to be transported;

feeding means for feeding the sheet material into said transport passage;

pressing means provided with a pressing surface projecting from said opposing surface toward said separation roller and having a coefficient of friction smaller than that of said opposing surface, said pressing means being adapted to press toward said separation roller via said pressing surface the sheet material fed into a nip between said separation roller and said retarding member by said feeding means, and said pressing means being adapted to retract in a direction in which said pressing surface moves away from said separation roller in correspondence with the thickness of the sheet material, wherein said feeding means includes pressure-contacting means disposed upstream of said pressing means and having a pressure-contacting surface opposing said separation roller and adapted to bring the sheet material into pressure contact with said separation roller before the sheet material is fed into said transport passage.

22. An automatic sheet-material feeder according to claim 21, wherein said pressing means is constituted by a spring member having said pressing surface and disposed in a groove formed in said opposing surface in such a manner that said pressing surface projects from said opposing surface.

23. An automatic sheet-material feeder according to claim 21, wherein said pressing means is constituted by a first member constituting said pressing surface and a second member formed of a resilient material and disposed in a groove formed in said opposing surface in such a manner that said first member projects from said opposing surface.

24. A automatic sheet-material feeder according to claim 21, wherein said pressure-contacting means is movable in such a manner that the distance between said separation roller and said pressure-contacting surface is changeable.

25. A automatic sheet-material feeder according to claim 24, further comprising:

changing means for changing the distance between said separation roller and said pressure-contacting surface by moving said pressure-contacting means.

* * * * *